US006039437A

United States Patent [19]

Tsujimoto

[11] Patent Number: 6,039,437

[45] **Date of Patent: *Mar. 21, 2000**

[54] INK-JET HEAD AND INK-JET PRINTING APPARATUS INCORPORATING THE SAME

[75] Inventor: Akira Tsujimoto, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/592,179

[22] Filed: Jan. 26, 1996

[30] Foreign Application Priority Data

Jan. 31, 1995 [JP] Japan ..... 7-014014

[51] Int. Cl.[7] ..... B41J 2/05

[52] U.S. Cl. ..... 347/63; 347/65; 347/92

[58] Field of Search ..... 347/63, 56, 92, 347/54, 20, 67, 65

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 5,576,750 | 11/1996 | Brandon et al. | 347/87 |

FOREIGN PATENT DOCUMENTS

| | | | |
|---|---|---|---|
| 0532877 | 3/1993 | European Pat. Off. . | |
| 0564276 | 10/1993 | European Pat. Off. . | |
| 2944005 | 5/1980 | Germany . | |
| 54-56847 | 5/1979 | Japan . | |
| 55-132253 | 10/1980 | Japan . | |
| 57-087962 | 6/1982 | Japan . | |
| 58-142865 | 8/1983 | Japan . | |
| 59-123670 | 7/1984 | Japan . | |
| 59-138461 | 8/1984 | Japan . | |
| 60-71260 | 4/1985 | Japan . | |
| 405338177 | 12/1993 | Japan | 347/92 |

*Primary Examiner*—N. Le
*Assistant Examiner*—Hai Pham
*Attorney, Agent, or Firm*—Fitzpatrick, Cella, Harper & Scinto

[57] ABSTRACT

An ink-jet head reduces bubbles retained in a liquid chamber and restricts growth of the bubbles, for facilitating recovery operation. Also, the ink-jet head makes a substrate, on which the electrothermal transducers are arranged, compact. The ink-jet head is formed by fitting the substrate to an upper plate formed with ink ejection openings, nozzle portions communicated with the ink ejection openings and the common liquid chamber, and an ink supply cylinder. The inner surface of the common liquid chamber extending from an ink ejection opening side to an opening portion and the inner surface extending from the side opposite to the ink ejection opening side to the opening portion are tilted in the same direction, to dispense with a horizontally extending portion on the upper portion of the liquid chamber. A recessed portion is formed at the outside of the peripheral wall corresponding to the inner surface.

20 Claims, 10 Drawing Sheets

INK-JET HEAD AND INK-JET PRINTING APPARATUS INCORPORATING THE SAME

BACKGROUND OF THE INVENTION

1. Field of the Invention

The present invention relates to an ink-jet head to be employed in an ink-jet printing apparatus which ejects a printing liquid (ink and so forth) through ejection openings (orifices) as flying liquid droplets and thus performs printing by depositing the liquid droplets on a printing medium, and to an ink-jet printing apparatus employing the ink-jet head.

It should be noted that, throughout the description and claims, the term "record" refers not only to recording characters but also to printing drawings, patterns and so forth.

2. Description of the Related Art

A typical one of conventional ink-jet heads has been disclosed in Japanese Patent Application Laid-open No. 132253/1980. The disclosed ink-jet head is constructed by fitting, onto a substrate formed with electrothermal transducers by way of film formation technology, an upper plate having ink-ejection openings, ink passages to be heat acting portions of the electrothermal transducers and a common liquid chamber for supplying ink to the ink passages. Also, a driver circuit for driving the electrothermal transducers arranged on the substrate is built in the substrate. Furthermore, a wiring substrate for wiring the driver circuit is provided. The substrate and the wiring substrate are located adjacently to each other on a heat radiating member.

With reference to FIGS. 5 and 6, the conventional ink-jet head will be further discussed hereinafter.

FIG. 5 is a schematic perspective view of the ink-jet head having the construction described above, and FIG. 6 is a schematic sectional view taken along line A—A of FIG. 5.

In FIG. 6, reference numeral 112 denotes a substrate, on which a plurality of electrothermal transducers are arranged; 113 denotes an upper plate which integrally incorporates a plurality of ink ejection openings 101, nozzle portions 102 serving as ink passages communicated with the ink ejection openings 101, a common liquid chamber 104 for supplying ink to respective nozzle portions 102, an ink supply cylinder 116 having an opening portion 105 in the upper surface of the common liquid chamber 104, and a liquid chamber frame portion 106 serving as a contacting portion to the substrate 112; 119 denotes the upper flat portion of the common liquid chamber 104; and 111 denotes a metal support member for constructing the ink-jet head by assembling various parts thereto.

Furthermore, as shown in FIG. 5, a wiring substrate 110 is arranged on the metal support member 111, and connected to the substrate 112 via bonding wires 109. The bonding wire 109 is adapted to electrically connect a pad 107 on the substrate 112 to a pad 108 on the wiring substrate 110.

In the afore-mentioned construction, discussing a flow of ink supply upon ink ejection, the ink flowing out of a tank (not shown) for storing the ink passes through various connection tubes and so forth to reach the ink supply cylinder 116 of the upper plate 113 and is temporarily accumulated in the common liquid chamber 104 via the opening 105 on the upper surface of the liquid chamber. The ink also flows to the respective nozzle portions 102 and is retained at the end of the ejection openings 101 by surface tension and so forth. Under this condition, when ejection signals are applied to the electrothermal transducers on the substrate 112, bubbles are generated in the ink within the corresponding nozzles 102, and ink droplets are ejected through the ink ejection openings 101.

Accordingly, when ejection is initiated, a required quantity of the ink has to be sequentially supplied to the nozzle portion from the common liquid chamber 104.

At this time, when bubbles 300 are present in the common liquid chamber 104 for some reason, ink supply to the nozzle portion is temporarily interrupted to make ink ejection unstable, and thus causing degradation of printing quality. Furthermore, when such condition is continued, ink ejection failure can be caused to thus make printing impossible.

The bubbles 300 may be generated either during printing or before initiation of printing. When the bubbles are generated during printing, a user may perform a recovery operation by means of capping and so forth to remove the bubbles from the liquid chamber. On the other hand, when bubbles have already been generated before initiation of printing, the recovery operation is automatically performed before starting ink ejection to remove the bubbles 300 from the liquid chamber.

Furthermore, concerning the ink-jet head maintained in the unused condition (a condition without performing printing) for a long period, the bubbles 300 may be grown by permeation of gas from the outside and/or penetration of air through the ejection openings and is retained (299) in the upper flat portion 119 of the common liquid chamber 104. Such bubbles residing in the common liquid chamber 104 will be hereinafter referred to as residual bubbles 299. In such a case, the residual bubbles 299 retained in the upper flat portion of the common liquid chamber are not only difficult to be removed by the recovery operation due to an excessively large difference in level relative to the ejection openings, but also degradate ink wettability in the nozzle and the liquid chamber, and thus causing degradation of the printing quality upon ejection.

Therefore, when the ink-jet head is unused for a long period, a given period is stored in the apparatus per se to automatically perform recovery operation at intervals of the given periods for removal of the residual bubbles in the liquid chamber and prevention of growth of the bubbles.

In EP-A 419181 is disclosed an ink-jet head where bubbles can be removed more easily from a liquid chamber.

However, in the prior art, since the flat portion 119 is present at the upper portion in the common liquid chamber 104, the rate of growth of the residual bubbles 299 is high for the presence of a large number of portions subject to permeation of gas from the outside in the construction where the ink flow passage from the ink tank to the ink ejection openings is long or where a large number of parts are to be connected.

Also, when the liquid chamber is small, even with a relatively small residual bubble 299, a degree of degradation of wettability of the nozzle and the liquid chamber becomes significant.

Therefore, particularly in the case of longtime storage, it becomes necessary to shorten the interval of the recovery operation of the apparatus i.e., to increase the frequency of the recovery operation in order to prevent residual and growth of the bubbles 299. This clearly increases consumption of the ink (a running cost associated with exchanging of the ink tank and so forth).

On the other hand, in the prior art, since the pads 107 for connection with the bonding wire 109 are arranged at the back side of the rear end of the upper plate on the substrate, in which the electrothermal transducers are formed, the substrate is extended rearwardly in the significant length. Accordingly, it becomes necessary to provide the substrate having an area greater than that required for the common liquid chamber and the liquid chamber frame. Therefore, when a large number of substrates, each of which is formed with the electrothermal transducers by film forming technology are to be simultaneously formed of a single silicon wafer, the number of substrates to be formed of the single silicon wafer must be reduced to cause an increase in cost.

SUMMARY OF THE INVENTION

Therefore, it is an object of the present invention to provide an ink-jet head and an ink-jet printing apparatus which can improve recovering performance for bubbles in a liquid chamber even in a construction having a long ink passage, a large number of parts to be connected or a relatively small liquid chamber, and can assure high quality printing.

Another object of the invention is to provide an ink-jet head which can reduce residual bubbles and growth of the residual bubbles to reduce the frequency of recovery operation and whereby to reduce ink consumption.

A further object of the invention is to provide an ink-jet head which enables down-sizing of a substrate and can be produced efficiently at a low cost.

In a first aspect of the present invention, there is provided an ink-jet head comprising:

a substrate arranged a plurality of ejection energy generating elements thereon and provided with wirings for driving the elements and connecting portions for electrically connecting the wirings at the rear end portion thereof;

an upper plate member to be fitted with the substrate and having a plurality of ink ejection openings, nozzle portions to be ink passages communicated with the ink ejection openings, a recessed portion to be at least one common liquid chamber communicated with the nozzle portions, and a supply cylinder communicated with the recessed portion via an opening portion; and wherein an inner surface of the common liquid chamber extending from an ink ejection opening side to the opening portion is tilted in a direction opposite to an ink ejecting direction, and an inner periphery of the common liquid chamber extending from the side opposite to the ink ejection opening side to the opening portion is tilted in the same direction as the former tilted inner surface.

The tilting angle of the inner surface extending from the ink ejection opening side to the opening portion in the direction opposite to the ink ejecting direction may be greater than the tilting angle of the inner surface extending from the side opposite to the ink ejection opening side to the opening portion.

The inner surface extending from the side opposite to the ink ejection opening side to the opening portion may be formed of two tilting surfaces of two different tilting angles.

The ink ejection energy generating elements may be electrothermal transducers generating thermal energy acting on ink.

In a second aspect of the present invention, there is provided an ink-jet head comprising:

a substrate arranged a plurality of ejection energy generating elements thereon and provided with wirings for driving the elements and connecting portions for electrically connecting the wirings at the rear end portion thereof;

an upper plate member to be fitted with the substrate and having a plurality of ink ejection openings, nozzle portions to be ink passages communicated with the ink ejection openings, a recessed portion to be at least one common liquid chamber communicated with the nozzle portions, and a supply cylinder communicated with the recessed portion via an opening portion; and wherein a rear end surface of the upper plate member in a direction opposite to an ink ejecting direction corresponding to a rear end of the substrate in the direction opposite to the ink ejecting direction, is recessed into a configuration avoiding interference with the connecting portion of the substrate.

A bonding wire may be connected to the connecting portion provided at the rear end of the substrate.

In a third aspect of the present invention, there is provided an ink-jet head comprising:

a substrate arranged a plurality of ejection energy generating elements thereon and provided with wirings for driving the elements and connecting portions for electrically connecting the wirings at the rear end portion thereof;

an upper plate member to be fitted with the substrate and having a plurality of ink ejection openings, nozzle portions to be ink passages communicated with the ink ejection openings, a recessed portion to be at least one common liquid chamber communicated with the nozzle portions, and a supply cylinder communicated with the recessed portion via an opening portion;

wherein an inner surface of the common liquid chamber extending from an ink ejection opening side to the opening portion is tilted in a direction opposite to an ink ejecting direction, and an inner periphery of the common liquid chamber extending from the side opposite to the ink ejection opening side to the opening portion is tilted in the same direction as the former tilted inner surface; and wherein a rear end surface of the upper plate member in a direction opposite to an ink ejecting direction corresponding to a rear end of the substrate in the direction opposite to the ink ejecting direction, is recessed into a configuration avoiding interference with the connecting portion of the substrate.

The tilting angle of the inner surface extending from the ink ejection opening side to the opening portion in the direction opposite to the ink ejecting direction may be greater than the tilting angle of the inner surface extending from the side opposite to the ink ejection opening side to the opening portion.

The inner surface extending from the side opposite to the ink ejection opening side to the opening portion may be formed of two tilting surfaces of two different tilting angles.

In a fourth aspect of the present invention, there is provided an ink-jet printing apparatus comprising, mounting means for mounting the ink-jet head as defined in any one of claims 1 to 11.

The mounting means may mount the ink-jet head with the ink ejection openings oriented downwardly.

In one aspect of the present invention, the inner surface of the common liquid chamber extending from the ink ejection opening side to the opening portion is tilted in the direction opposite to the direction of ink ejection, and the inner surface of the common liquid chamber extending from the opposite side to the ink ejection opening side to the opening portion is tilted in the same direction as the former tilted inner surface. Therefore, substantially no horizontally extending flat portion is present in the upper portion of the common liquid chamber toward the opening portion of the common liquid chamber in the upper plate. The tilted inner surfaces serve to make bubbles, which may be retained in the liquid chamber otherwise, escape through the opening portion. Furthermore, the tilted inner surfaces may reduce a residual period of the bubbles to effectively prevent growth of bubbles per se. Also, in ejection and recovery operation, the tilted inner surfaces may serve to smoothly supply the ink from the opening portion the common liquid chamber of to the ejection opening (nozzle side).

By this, recovery performance can be improved to achieve the effects of reduction of the residual bubbles and of suppression of growth of the bubbles in the liquid chamber.

Furthermore, according to another aspect of the invention, the rear end portion of the upper plate on the opposite side to the ink ejection opening side, corresponding to the rear end portion of the substrate on the opposite side to the ink ejection opening side, is recessed for avoiding interference with the connecting portion of the substrate. Therefore, it becomes unnecessary to extend the substrate rearwardly for avoiding interference between the connecting portion of the substrate and the rear end portion of the upper plate. Thus, the substrate and the upper plate can be fitted in the area substantially approximate to the necessary area for the common liquid chamber and the liquid chamber frame. Accordingly, when a plurality of substrates with the electrothermal transducers are simultaneously formed of a single silicon wafer by way of a film forming apparatus and so forth, the number of the substrates to be formed can be increased to lower the production cost.

BRIEF DESCRIPTION OF THE DRAWINGS

The present invention will be understood more fully from the detailed description given herebelow and from the accompanying drawings of the preferred embodiments of the invention, which, however, should not be taken to be limitative to the present invention, but are for explanation and understanding only.

In the drawings.

DESCRIPTION OF THE PREFERRED EMBODIMENTS

Preferred embodiments of an ink-jet head and an ink-jet printing apparatus according to the present invention will be discussed hereinafter in detail with reference to the accompanying drawings.

Figure 1:
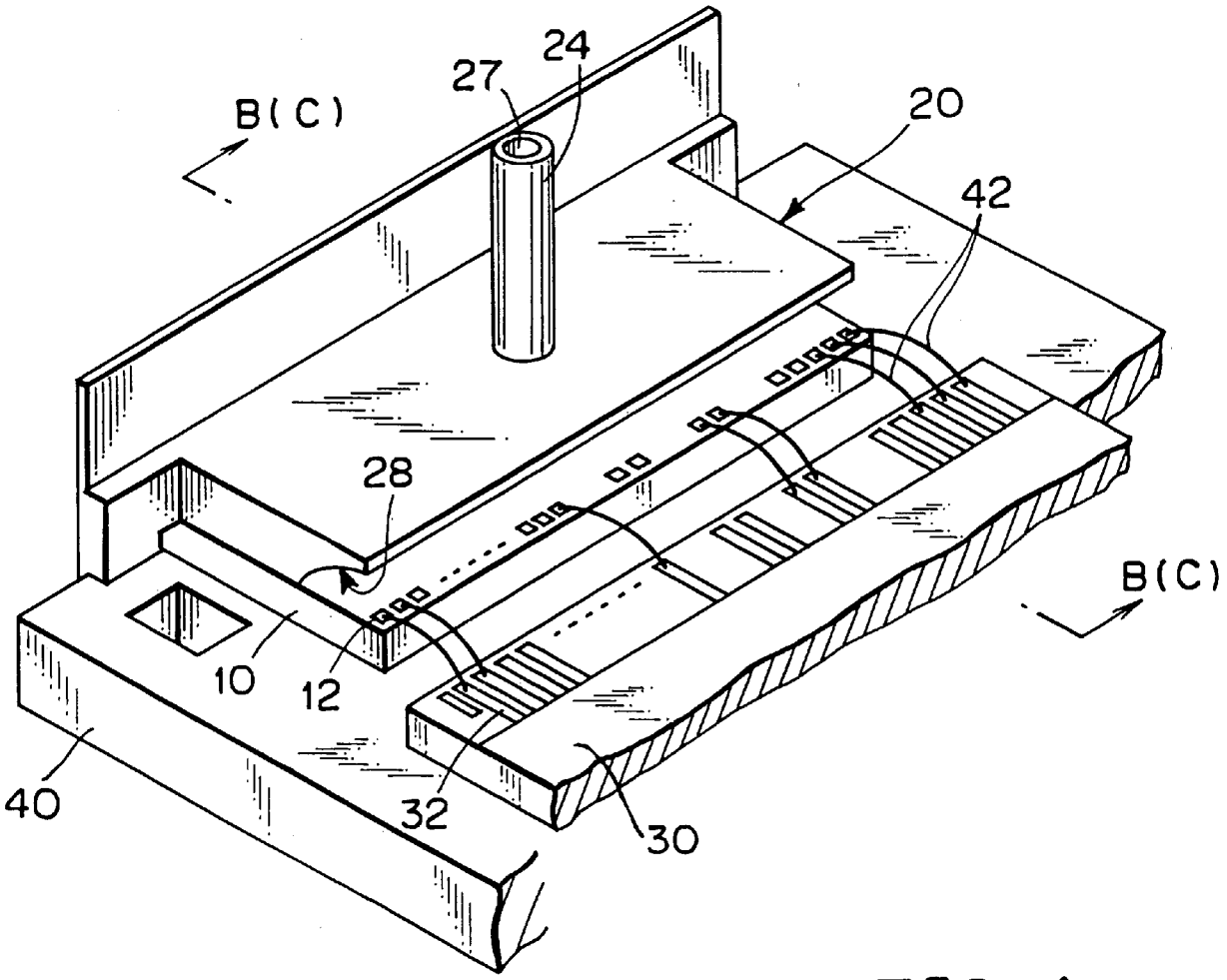
FIG. 1 is a perspective view of a first preferred embodiment of an ink-jet head according to the present invention.

FIG. 1 is a perspective view generally showing a part of an ink-jet head, to which the present invention is applied.

In FIG. 1, reference numeral 10 denotes a substrate formed of ceramic or so forth. As is well known, a plurality of electrothermal transducers 11 (see FIG. 2) as ejection energy generating elements, formed by film forming technology, are arranged on the substrate 10. While not illustrated, driver circuits for driving the electrothermal transducers 11 are simultaneously formed on the substrate 10. Furthermore, pads 12 for connecting the driver circuits are provided at the rear portion of the substrate 10. Reference numeral 20 denotes an upper plate to be fitted with the substrate 10, which upper plate will be discussed later. Reference numeral 30 denotes a wiring substrate to be connected to the driver circuits of the substrate 10. Pads 32 corresponding to the pads 12 of the substrate 10 are provided on the wiring substrate 30.

The substrate 10 and the wiring substrate 30 are arranged in side-by-side relationship on a support plate 40 made of a metal material having high heat conductivity, such as aluminum, for heat radiation. Both the pads 12 and 32 are connected to each other by means of bonding wires 42.

Figure 2:
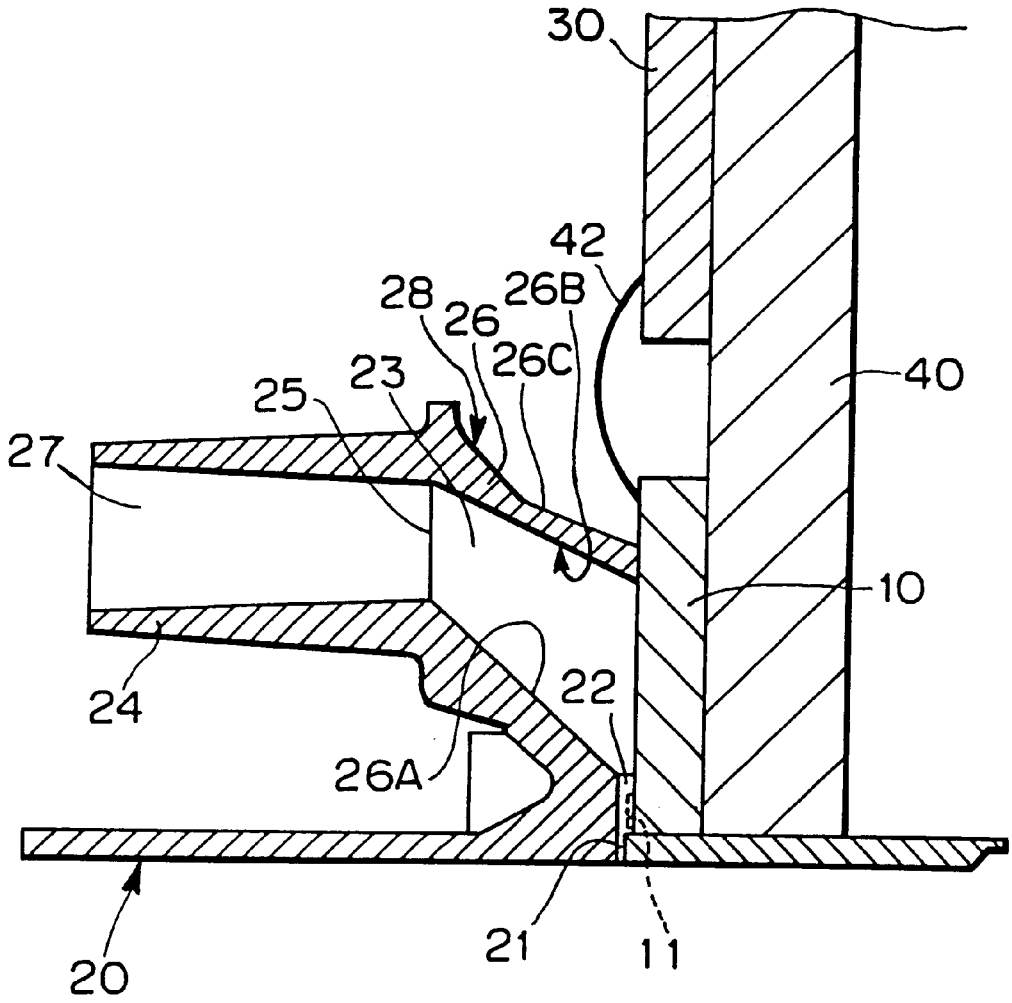
FIG. 2 is a sectional view taken along line B—B of FIG. 1, illustrating the first embodiment of the ink-jet head according to the invention.

Next, the first embodiment of the present invention will be discussed also with reference to FIG. 2.

In the upper plate 20, a plurality of ink ejection openings 21 are formed. The ink ejection openings 21 are downwardly oriented in perpendicular direction to the surface of a printing medium and arranged in parallel relationship to each other in the form of an array. Also, the upper plate 20 is formed with a plurality of grooves which define nozzle portions 22 serving as ink passages communicated with the ink ejection openings 21 as fitted with the substrate 10. Reference numeral 23 denotes a recessed portion formed in a liquid chamber frame 26 for defining a common liquid chamber communicated with the plurality of nozzle portions 22. With the recessed portion or common liquid chamber 23 is communicated an ink passage 27 inside an ink supply cylinder 24 formed integrally with the liquid chamber frame 26 via an opening portion 25 (here, the opening portion referred to throughout the description means a boundary portion between the ink passage 27 inside the ink supply cylinder 24 and the common liquid chamber 23).

Figure 10:
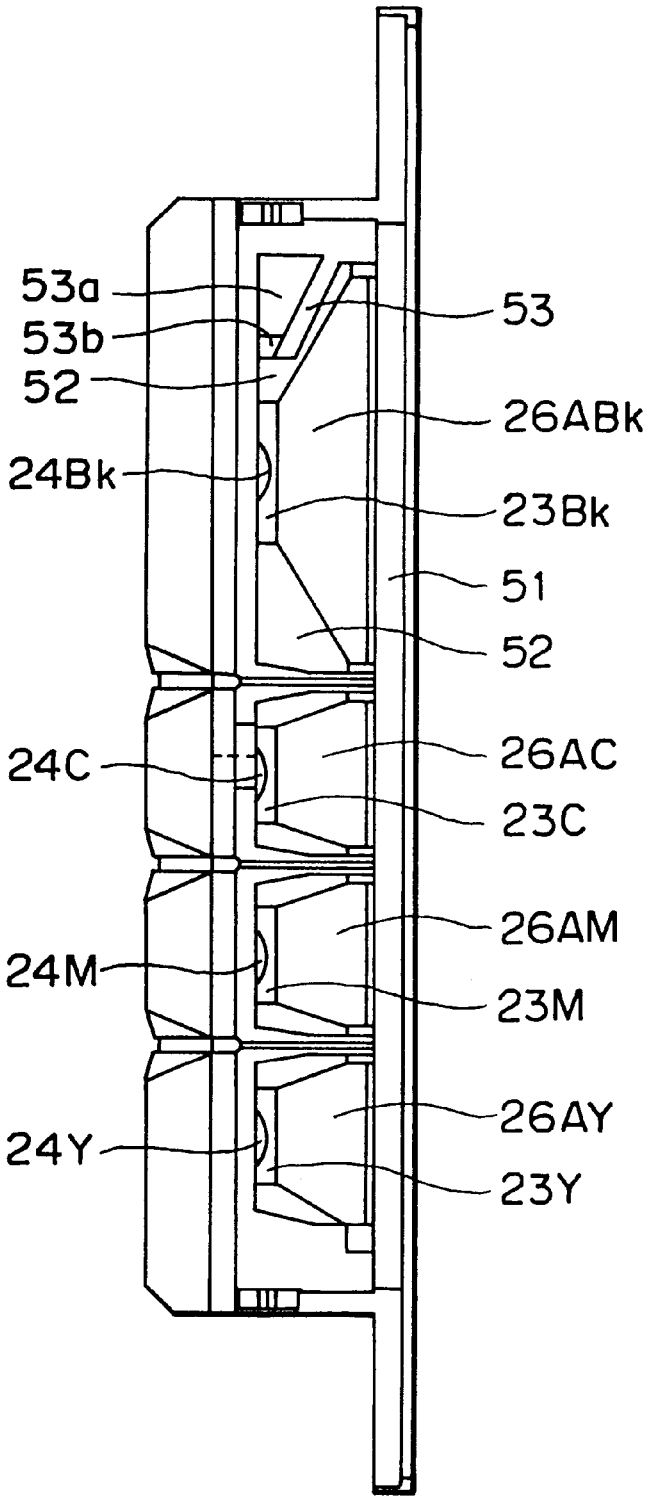
FIG. 10 is a schematic bottom view showing the grooved upper plate of the fourth embodiment of the ink-jet head according to the present invention, as viewed from the side of a substrate.

An inner surface 26A extending from an ink ejection opening 21 side of the common liquid chamber 23, namely, a communicating portion with the nozzle portion 22 to the opening portion 25, is tilted in a direction opposite to the ink ejecting direction (corresponding structure can be seen in FIG. 10 at surfaces 26ABk, 26AC, 26AM, and 26AY). Also, an inner surface 26B extending from the side opposite to the ink ejection opening side to the opening portion 25, is also tilted in the same tilting direction as that of the inner surface 26A. It should be noted that the tilting angle of the inner surface 26A is greater than that of the inner surface 26B. This is for increasing the capacity of the common liquid chamber 23 while obtaining desired effects.

On the other hand, a rear end surface 26C of the liquid chamber frame 26 corresponding to the rear end portion of the substrate 10 where the pads 12 are arranged, is formed with a recessed surface having a gradient approximately equal to that of the inner surface 26B, to define a recessed portion 28 (see FIG. 1). The recessed portion 28 serves to avoid interference with the connecting portion where the pads 12 and the bonding wires 42 are arranged corresponding structure can be seen in FIG. 9 at surfaces 26CBk, 26CC, 26CM, and 26CY.

According to the shown embodiment, since the inner surfaces 26A and 26B of the common liquid chamber 23 are formed to have a surface configuration ascendingly tilted toward the opening portion 25, substantially no horizontally extending flat portion to the opening portion 25 is present on the upper portion of the common liquid chamber 23. Thus, even if bubbles are generated in the common liquid chamber 23, the inner surfaces 26A and 26B having a tilting gradient, may make the bubbles, which can remain otherwise, escape through the opening portion 25. Furthermore, since the remaining period of the bubbles can be shortened by the inner surfaces 26A and 26B having a tilting gradient, growth of the bubbles per se can be prevented. On the other hand, since the tilted inner surfaces 26A and 26B smoothly guide the ink toward the ink ejection openings 21 (nozzle portions 22) in ejection and recovery operation, ink supply can be performed smoothly without causing disturbance of the ink flow. By this, the recovery performance can be improved so that an amount of the growth of the bubbles remaining in the liquid chamber and the bubbles growth can be reduced even in the case of non-usage for a long period.

Furthermore, according to the shown embodiment, the rear end surface of the upper plate 20 in the direction opposite to the ink ejection opening side is formed as the recessed surface 26C, interference with the connecting portion including the bonding wires 42 and so forth can be avoided. Therefore, the area to be occupied by the driver circuits for the electrothermal transducers 11 can be reduced to permit down-sizing of the substrate 10.

Figure 3:
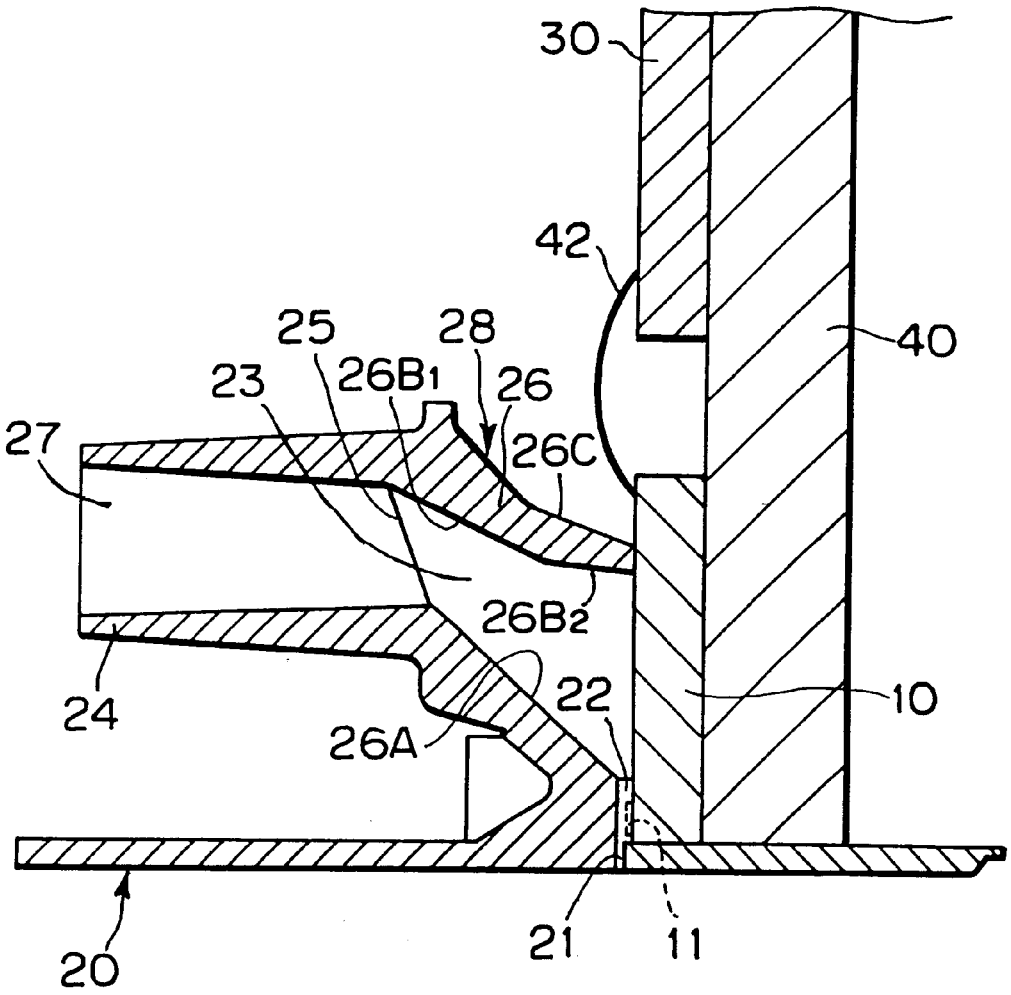
FIG. 3 is a sectional view taken along line C—C of FIG. 1, illustrating a second embodiment of the ink-jet head according to the invention.

FIG. 3 is a sectional view taken along the line C—C of FIG. 1, illustrating a second embodiment according to the present invention (since the external appearance of the ink-jet head of this embodiment is the same as that of the first embodiment, reference is made to FIG. 1).

A difference between the second embodiment and the first embodiment is that the inner surface of the common liquid chamber 23 on the side opposite to the ink ejection opening side is formed into two tilted surfaces 26B1 and 26B2. Namely, while the inner surface 26B1 has substantially the same tilting angle as that of the inner surface 26B of the former embodiment, the inner surface 26B2 is formed at a smaller tilting angle (closer to the right angle with respect to the substrate 10). Since other construction is similar to the first embodiment, the same function portions are represented by the same reference numerals for avoiding redundant discussion.

Figure 7:
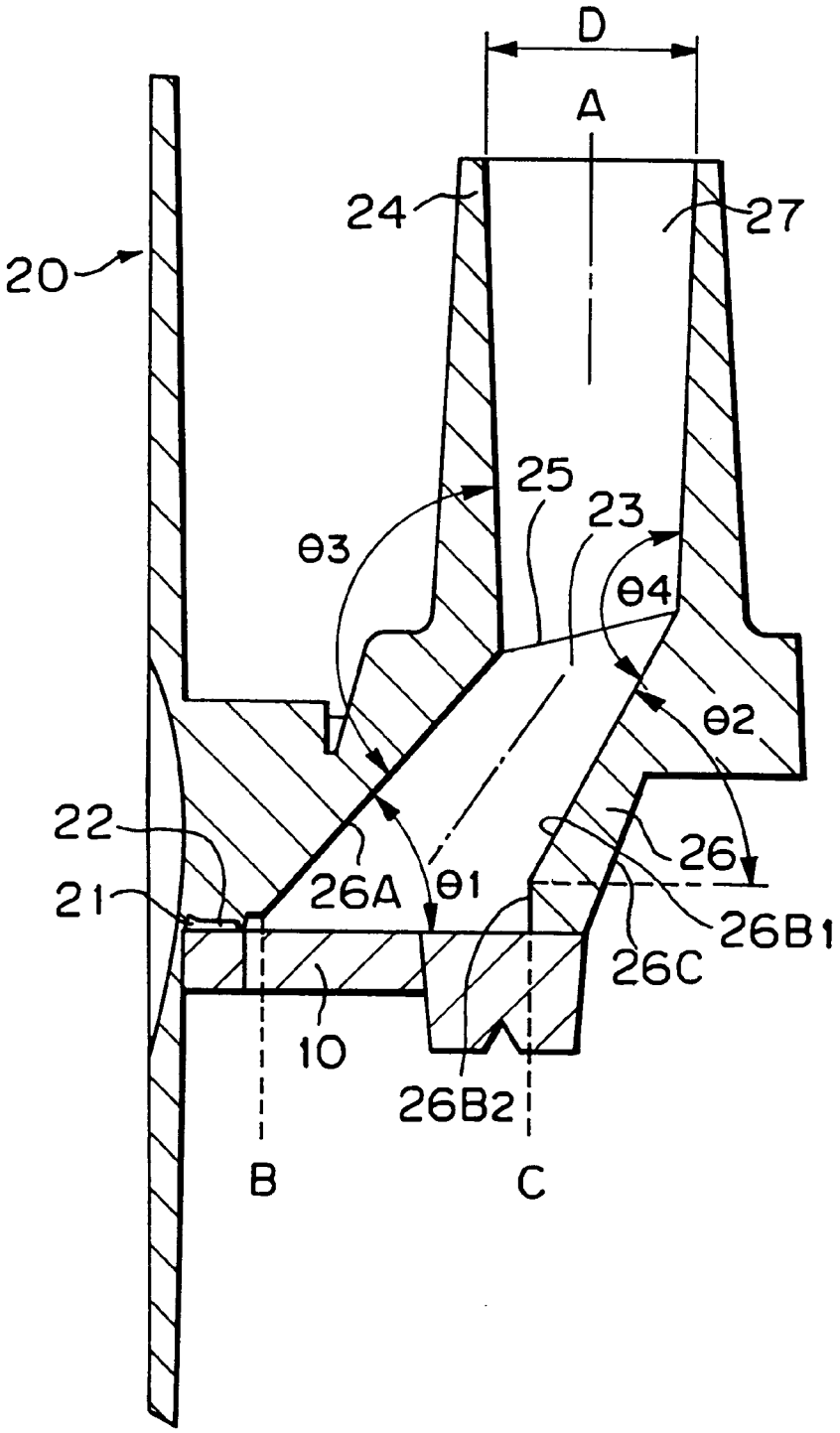
FIG. 7 is a schematic cross sectional view of a third embodiment of an ink-jet head according to the present invention.

FIG. 7 is a schematic cross sectional view of a third embodiment of an ink-jet head according to the present invention.

A principal difference of this embodiment from the second embodiment is that an inner surface $26B_2$ is reduced in size and slightly tilted in a direction opposite to that in the second embodiment.

It is preferable that the cross-sectional shape of an ink passage extending from the opening portion 25 of the common liquid chamber 23 to the inlet of the nozzle portion 22 be gradually enlarged from the opening portion of the common liquid chamber 23 toward the inlet of the nozzle portion 22 (between B and C). Namely, the relationship between an angle θ1 formed between the top surface of the substrate 10 (hereinafter, referred to as a heater surface) and the inner surface 26A and an angle θ2 formed between the heater surface and the inner surface $26B_1$ is preferably established by the following inequality:

$$\theta 1<\theta 2$$

The desirable angular ranges of the angles θ1 and θ2 are given, respectively, as follows:

$$30^\circ \leqq \theta 1 \leqq 75^\circ$$

$$40^\circ \leqq \theta 2 \leqq 80^\circ$$

and more preferably, as follows:

$$45^\circ \leqq \theta 1 \leqq 60^\circ$$

$$60^\circ \leqq \theta 2 \leqq 75^\circ$$

The upper limits of the angles θ1 and θ2 are determined so that pressure fluctuation in the ink passage, in particular, pressure fluctuation of ink in the vicinity of the inlet of the nozzle portion 22 could be within suitable values. The lower limits of the angles θ1 and θ2 are determined mainly so that fluid resistance in the ink passage could be within appropriate values so as to make the ink or bubbles flow easily.

Meanwhile, it is preferable that a center line (A) in the cross section of the ink passage extending from the inlet of an ink supply cylinder 24 to the inlet of the nozzle portion 22 through the opening portion 25 of the common liquid chamber 23 be bent toward the inlet of the nozzle portion 22 around the opening portion of the common liquid chamber 23. Moreover, it is preferable that the cross-sectional shape of the ink passage extending from the inlet of the ink supply cylinder 24 to the opening portion of the common liquid chamber 23 be gradually tapered from the inlet of the ink supply cylinder 24 (having an inner diameter D) toward the opening portion of the common liquid chamber 23. The relationship between a bending angle θ3 of the inner surface 26A and a bending angle θ4 of the inner surface $26B_1$ is preferably established by the following inequality:

$$\theta 3<\theta 4$$

The desirable angular ranges of the angles θ3 and θ4 are given, respectively, as follows:

$$120^\circ \leqq \theta 3 < 180^\circ$$

$$130^\circ \leqq \theta 4 < 180^\circ$$

and more preferably, as follows:

$$135^\circ \leqq \theta 3 \leqq 150^\circ \leqq \theta 4 \leqq 170^\circ$$

The upper and lower limits of the angles θ3 and θ4 are determined so that both pressure fluctuation and fluid resistance in the ink passage could be within appropriate values.

It is preferred that an ending point (a base point of the angle θ3) of the inner surface 26A at the opening portion 25 of the common liquid chamber 23 be farther from the inlet of the ink supply cylinder 24 than a bending point (a base point of the angle θ4) of the inner surface $26B_1$ at the opening portion of the common liquid chamber 23, thus improving flowability (removability) of the bubbles. This is because the bending point of the inner surface $26B_1$ is more apt to effect on the flow of the bubble than the bending point of the inner surface 26A.

Figure 8:
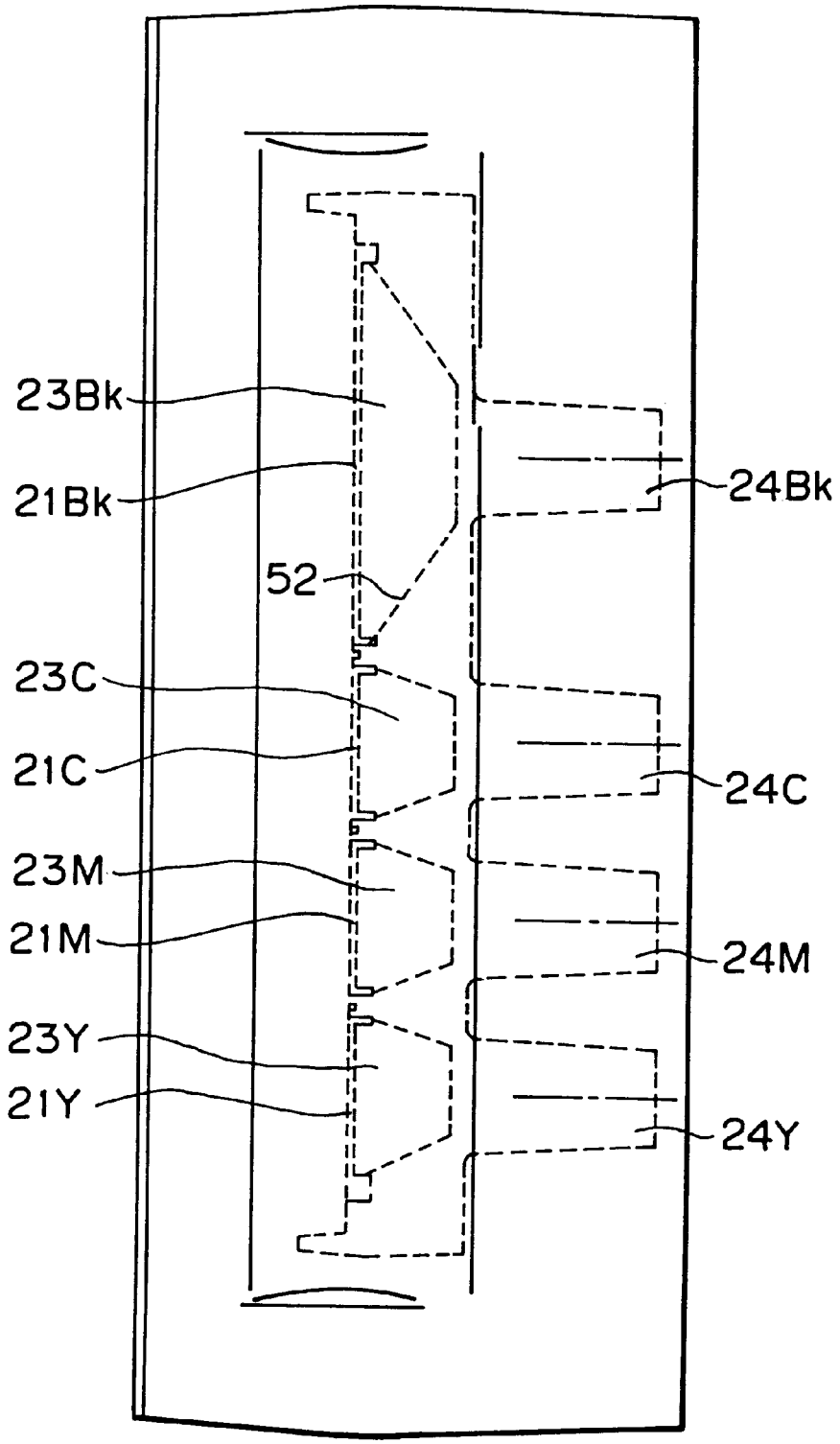
FIG. 8 is a schematic front view showing a grooved upper plate of a fourth embodiment of an ink-jet head according to the present invention, as viewed in a direction of ejection openings.
Figure 9:
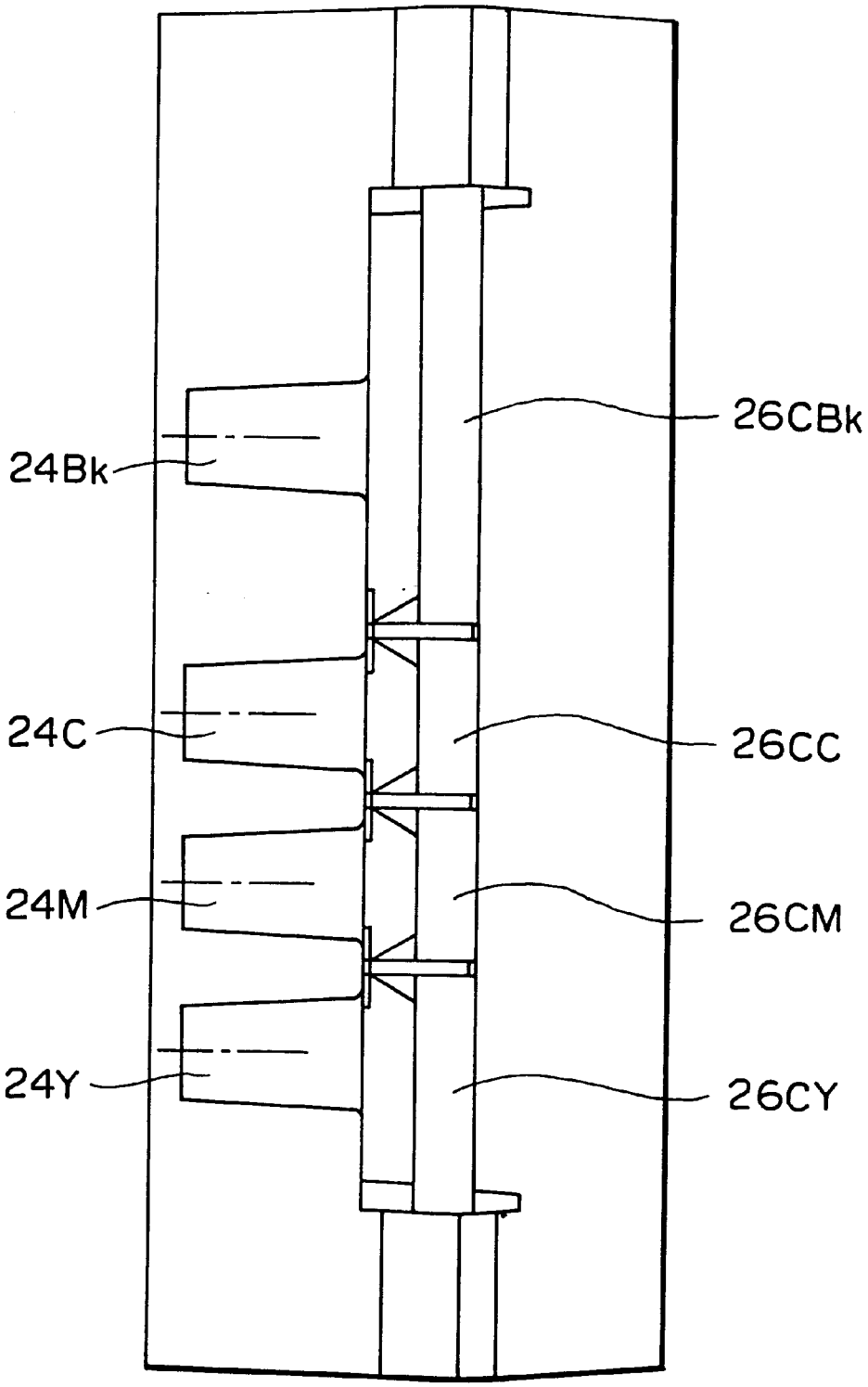
FIG. 9 is a schematic rear view showing the grooved upper plate of the fourth embodiment of the ink-jet head according to the present invention, as viewed in the direction of the ejection openings.

FIGS. 8 through 10 are a schematic front view, a schematic rear view, and a schematic bottom view, respectively, showing a grooved upper plate of an ink-jet head in a fourth embodiment according to the present invention.

An ink passage reaching the ejection openings is divided into four channels, each internal structure of which is almost the same as that in the third embodiment. In this embodiment, inks of different colors are supplied to the channels, respectively. Namely, black ink is supplied from an ink supply cylinder 24Bk to ejection openings 21Bk through a common ink chamber 23Bk. In the same manner, cyan ink is supplied from an ink supply cylinder 24C to ejection openings 21C through a common ink chamber 23C; magenta ink from an ink supply cylinder 24M to ejection openings 21M through a common ink chamber 23M; and yellow ink, from an ink supply cylinder 24Y to ejection openings 21Y through a common ink chamber 23Y. A plurality of nozzle portions, not shown, are provided in a part denoted by reference numeral 51 in FIG. 10.

In the case where the common ink chamber is relatively small as in this embodiment, the ink supplied from the ink supply cylinder flows into common ink chamber as it is. Consequently, the present invention can be favorably applied to the ink-jet head in this embodiment because diffusion of the ink is relatively small. It is much preferable from the viewpoints of ink supplying performance and bubble removing performance that not only the inner surface 26A but also inner tilted surfaces 52 of the common ink chamber extending from the opening portion of the common ink chamber to the nozzle portion, which are positioned at opposite sides of the common liquid chamber with respect to the direction of typically designated by reference numeral 52, be tilted the array of ejection openings, as illustrated in FIG. 10.

Incidentally, reference numeral 53 in FIG. 10 denotes a plate-like projecting member for forming a separate chamber 53 within the common ink chamber so as to act as a buffering portion for aggregatively retaining the bubbles. One end of the projecting member extends in a direction perpendicular to the plane of FIG. 10 and the other end is connected to the substrate 10 to be connected to the grooved upper plate shown in FIG. 10. The chamber 53*a* defined by the projecting member 53 has the same depth as that of the position of the opening portion of the ink supply cylinder 24 Bk shown in FIG. 10. In order to make communication the chamber 53*a* with the common ink chamber, a relatively shallow slit 53*b* is provided between the projecting member 53 and the ink chamber frame.

As apparent from the above description, the present invention is favorably applied to the ink-jet head where the ink is ejected through the ejection openings approximately downward in the vertical direction.

Figure 4:
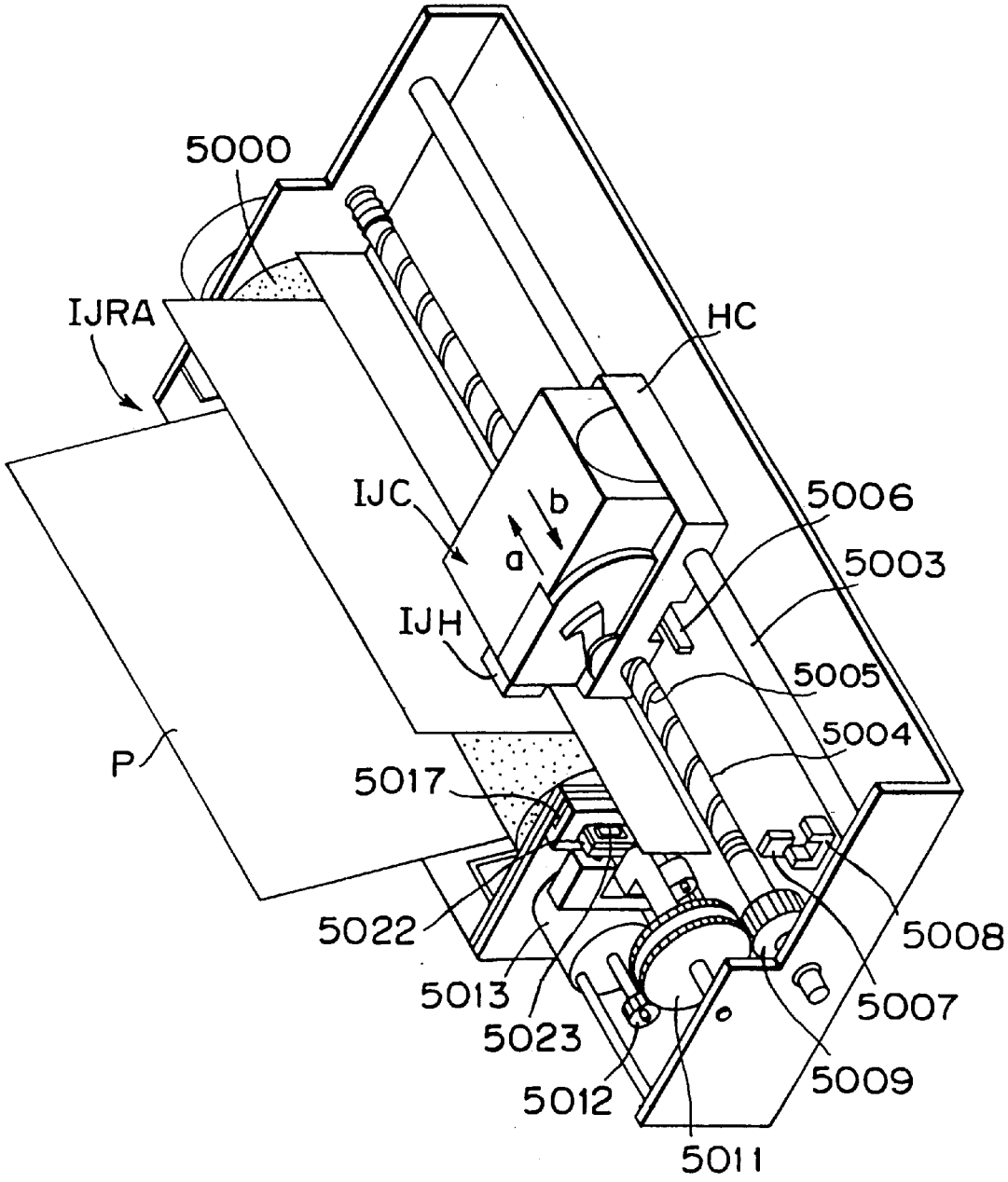
FIG. 4 is a perspective view of an ink-jet printing apparatus in which the ink-jet head according to the present invention is mounted.
Figure 5:
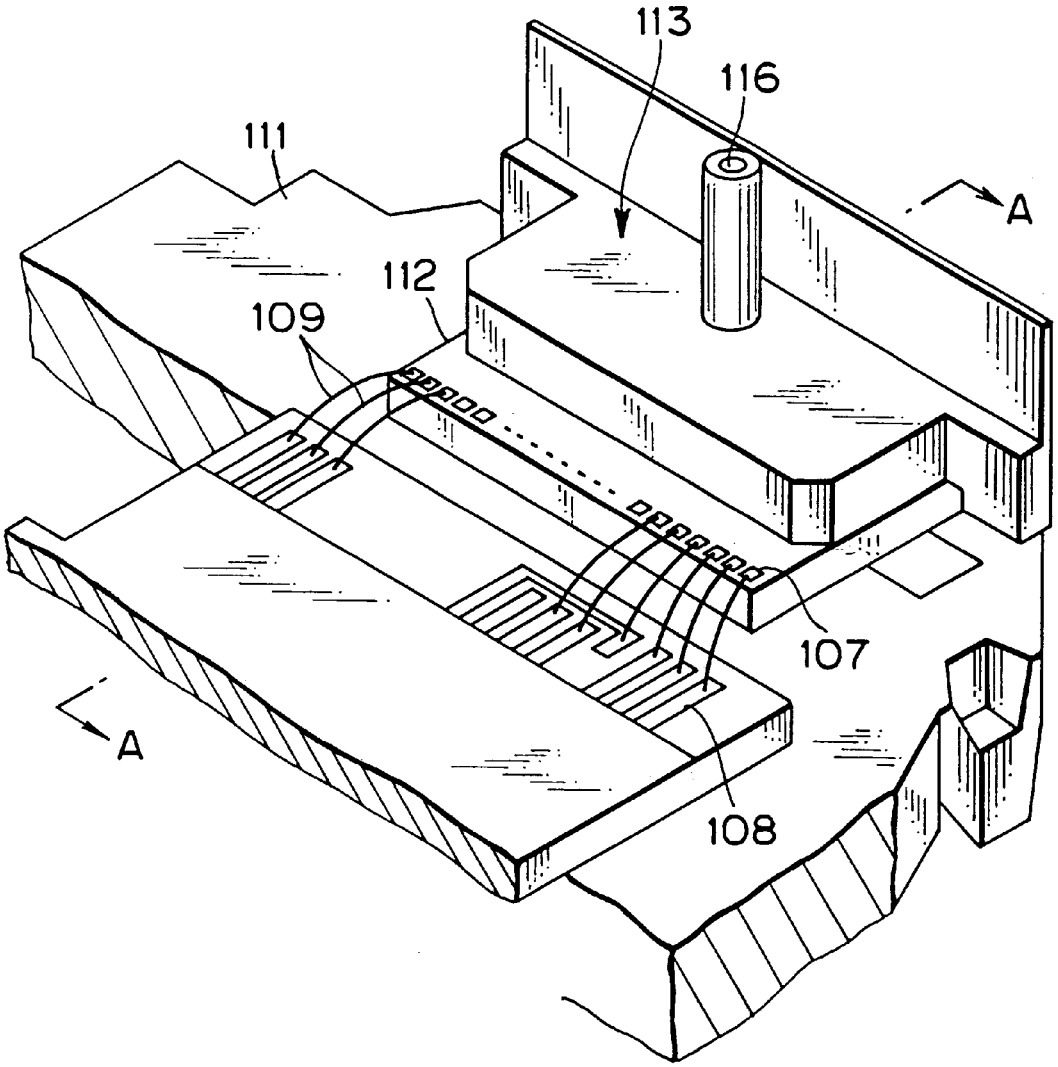
FIG. 5 (PRIOR ART)
FIG. 5 is a perspective view showing the construction of a conventional ink-jet head.
Figure 6:
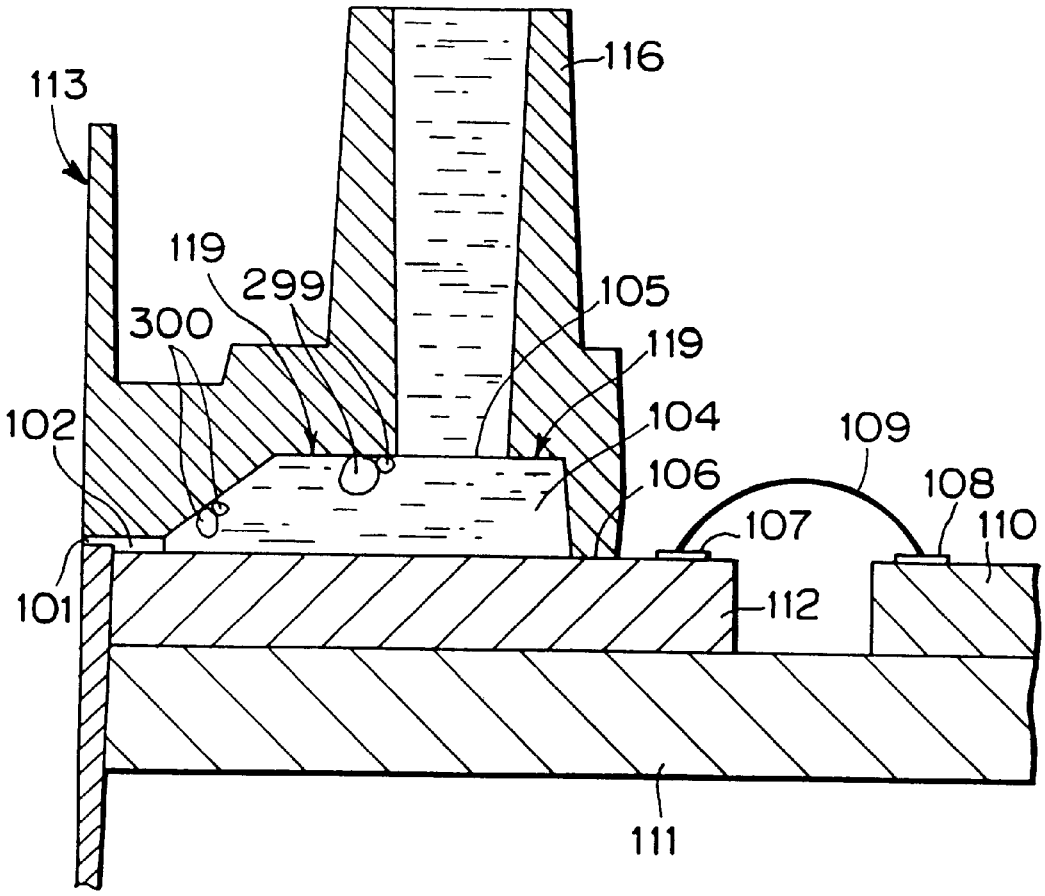
FIG. 6 (PRIOR ART)
FIG. 6 is a sectional view taken along line A—A of FIG. 5, showing the construction of the conventional ink-jet head.

Next, one example of ink-jet recording apparatus IJRA provided with the ink-jet head, according to the present invention, is illustrated in FIG. 4.

An ink-jet head IJH has an ink supply cylinder 24 detachably set in an ink supply opening of an ink tank and is installed on a carriage HC with directing the ink ejection openings 21 downward, as an integral ink-jet cartridge IJC. Here, the carriage HC is slidingly guided by a guide rod 5003 and reciprocative shifted in the directions of arrows a and b via a motor 5013, gears 5012, 5011, 5009 and a lead screw 5004 formed with a feed thread 5005. Accordingly, the ink-jet head IJH installed in the carriage HC is reciprocated with opposing to a sheet of paper P on a platen 5000. Rns 5007 and 5008 are photo-couplers for detecting a home position by moving a lever 5006 in and out. Rn 5022 is a capping member contacting with an ejection surface of the ink-jet head IJH which performs suction recovery of the ink-jet head IJH via an opening portion 5023 thereof. On the other hand, rn 5017 is a cleaning blade.

These capping, cleaning and suction recovery are performed in desired operation with taking timings at corresponding positions.

The present invention achieves distinct effects on ink supplying performance and bubble removing performance when applied to a recording head or a recording apparatus which has means for generating thermal energy such as electrothermal transducers or laser light, and which causes changes in ink including generation of bubbles by the thermal energy so as to eject ink. Such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to an on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces a sudden temperature rise that exceeds nucleate boiling so as to cause film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink droplets. The drive signal in the form of a pulse is much preferable because the growth and collapse of the bubbles can be achieved instantaneously and suitably so that the liquid (ink) excellent in responsiveness can be expelled. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, the liquid passages and the electrothermal transducers disclosed in the above patents. Moreover, the present invention can be applied to structures disclosed in Japanese Patent Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum width across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink the main assembly from; and a cartridge type recording head integrally including an ink tank.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet head comprising:

a substrate having a plurality of ejection energy generating elements arranged thereon and a plurality of wirings for driving said elements, respectively, and a connecting portion for electrically connecting said wirings at a rear end portion thereof;

an upper plate member fitted to said substrate and having a plurality of ink ejection openings, a plurality of nozzle portions which are part of a plurality of ink passages communicated with said ink ejection openings, a recessed portion comprising at least one common liquid chamber communicated with said nozzle portions, and an opening portion communicated with said recessed portion, said common liquid chamber having a first inner side surface extending from the ink ejection opening side to the opening portion and a second inner side surface extending from the side opposite to the ink election opening side to the opening portion; and wherein the first inner side surface of said common liquid chamber is tilted in a direction opposite to an ink ejecting direction, the second inner side surface of said common liquid chamber is tilted in a same direction as said first inner side surface, and a tilting angle of the second inner side surface is greater than a tilting angle of the first inner side surface.

2. An ink-jet head as claimed in claim 1, wherein said ink ejection energy generating elements are electrothermal transducers generating thermal energy acting on ink.

3. An ink-jet head as in claim 1, wherein said first inner side surface and said second inner side surface converge toward said opening portion.

4. An ink-jet head comprising:

a substrate having a plurality of election energy generating elements arranged thereon and a plurality of wirings for driving said elements, respectively, and a connecting portion for electrically connecting said wirings at a rear end portion thereof;

an upper plate member fitted to said substrate and having a plurality of ink election openings, a plurality of nozzle portions which are part of a plurality of ink passages communicated with said ink election openings, a recessed portion comprising at least one common liquid chamber communicated with said nozzle portions, and an opening poriton said communicated with said recessed portion, said common liquid chamber having a first inner side surface extending from the ink election opening side to the opening portion and a second inner side surface extending from the side opposite to the ink election opening side to the opening portion; and wherein the first inner side surface of said common liquid chamber is tilted in a direction opposite to an ink ejecting direction, the second inner side surface of said common liquid chamber is tilted in a same direction as said first inner side surface, and a tilting angle of the second inner side surface is greater than a tilting angle of the first inner side surface, and wherein the second inner side surface is formed from two tilting surfaces having two different tilting angles.

5. An ink-jet head comprising:

a substrate arranged with a plurality of ejection energy generating elements thereon and a plurality of wirings for driving said elements, respectively, and a connecting portion for electrically connecting said wirings at a rear end portion thereof;

an upper plate member fitted to said substrate and having a plurality of ink ejection openings, a plurality of nozzle portions which are a part of a plurality of ink passages communicated with said ink ejection openings, a recessed portion comprising at least one common liquid chamber communicated with said nozzle portions, an opening portion communicated with said recessed portion and a rear end surface, said common liquid chamber having a first inner side surface extending from the ink ejection opening side to the opening portion and a second inner side surface extending from the side opposite to the ink election opening side to the opening portion; and wherein the rear end surface of said upper plate member is tilted in a direction opposite to an ink ejecting direction corresponding to the rear end portion of said substrate in the direction opposite to the ink ejecting direction, and is recessed into a configuration avoiding interference with said connecting portion of said substrate.

6. An ink-jet head as claimed in claim 5, wherein a bonding wire is connected to said connecting portion provided at the rear end portion of said substrate.

7. An ink-jet head as claimed in claim 5, wherein said ink ejection energy generating elements are electrothermal transducers generating thermal energy acting on ink.

8. An ink-jet head as in claim 5, wherein said first inner side surface and said second inner side surface converge toward said opening portion.

9. An ink-jet head comprising:

a substrate having a plurality of ejection energy generating elements thereon and a plurality of wirings for driving said elements, respectively, a connecting portion for electrically connecting said wirings at a rear end portion thereof;

an upper plate member fitted to said substrate and having a plurality of ink ejection openings, a plurality of nozzle portions which are part of a plurality of ink passages communicated with said ink ejection openings, a recessed portion comprising at least one common liquid chamber communicated with said nozzle portions, an opening portion communicated with said recessed portion and a rear end surface, said common liquid chamber having a first inner side surface extending from the ink election opening side to the opening portion, a second inner side surface extending from the side opposite to the ink election opening side to the opening portion, wherein the first inner side surface of said common liquid chamber is tilted in a direction opposite to an ink ejecting direction, the second inner said surface of said common liquid chamber is tilted in a same direction as said first inner side surface, and a tilting angle of the second inner side surface is greater than a tilting angle of the first inner side surface; and wherein the rear end surface of said upper plate member is tilted in a direction opposite to an ink ejecting direction corresponding to a rear end portion of said substrate in the direction opposite to the ink ejecting direction, and is recessed into a configuration avoiding interference with said connecting portion of said substrate.

10. An ink-jet head as claimed in claim 9, wherein the second inner side surface extending from the side opposite to the ink ejection opening side to said opening portion is formed from two tilting surfaces having two different tilting angles.

11. An ink-jet head as claimed in claim 9, wherein said ink ejection energy generating elements are electrothermal transducers generating thermal energy acting on ink.

12. An ink-jet head as in claim 9, wherein said first inner side surface and said second inner side surface converge toward said opening portion.

13. An ink-jet printing apparatus comprising:

an ink-jet head comprising;

a substrate having a plurality of election energy generating elements arranged thereon and a plurality of wirings for driving said elements, respectively, and a connecting portion for electrically connecting said wirings at a rear end portion thereof, an upper plate member fitted to said substrate and having a plurality of ink election openings, a plurality of nozzle portions which are part of a plurality of ink passages communicated with said ink election openings, a recessed portion comprising at least one common liquid chamber communicated with said nozzle portions, and an opening portion communicated with said recessed portion, said common liquid chamber having a first inner side surface extending from the ink election opening side to the opening portion and a second inner side surface extending from the side opposite to the ink election opening side to the opening portion; and wherein the first inner side surface of said common liquid chamber is tilted in a direction opposite to an ink electing direction, the second inner side surface of said common liquid chamber is tilted in a same direction as the first inner side surface, and a tilting angle of the second inner side surface is greater than a tilting angle of the first inner side surface, and mounting means for mounting said ink-jet head.

14. An ink-jet printing apparatus as claimed in claim 13, wherein said mounting means mounts said ink-jet head with said ink ejection openings oriented downwardly.

15. An ink-jet printing apparatus, comprising:

an ink-jet head comprising;

a substrate having a plurality of ejection energy generating elements arranged thereon and a plurality of wirings for driving said elements, respectively, and a connecting portion for electrically connecting said wirings at a rear end portion thereof;

an upper plate member fitted to said substrate and having a plurality of ink ejection openings, a plurality of nozzle portions which are part of a plurality of ink passages communicated with said ink ejection openings, a recessed portion comprising at least one common liquid chamber communicated with said nozzle portions, and an opening portion communicated with said recessed portion, said common liquid chamber having a first inner side surface extending from the ink ejection opening side to the opening portion, a second inner side surface extending from the side opposite to the ink ejection opening side to the opening portion; and wherein the first inner side surface of said common liquid chamber is tilted in a direction opposite to an ink ejecting direction, the second inner side surface of said common liquid chamber is tilted in a same direction as said first inner side surface, and a tilting angle of the first inner side surface, and wherein the second inner side surface is formed from two tilting surfaces having two different tilting angles; and mounting means for mounting said ink-jet head.

16. An ink-jet printing apparatus as in claim 15, wherein said mounting means mounts said ink-jet head with said ink ejection openings oriented downwardly.

17. An ink-jet printing apparatus, comprising:

an ink-jet head comprising:

a substrate arranged with a plurality of ejection energy generating elements thereon and a plurality of wirings for driving said elements, respectively, and a connecting portion for electrically connecting said wirings at a rear end portion thereof, an upper plate member fitted to said substrate and having a plurality of ink ejection openings, a plurality of nozzle portions which are a part of a plurality of ink passages communicated with said ink ejection openings, a recessed portion comprising at least one common liquid chamber communicated with said nozzle portions, an opening portion communicated with said recessed portion and a rear end surface, said common liquid chamber having a first inner side surface extending from the ink ejection opening side to the opening portion and a second inner side surface extending from the side opposite to the ink ejection opening side to the opening portion; and wherein the rear end surface of said upper plate member is tilted in a direction opposite to an ink ejecting direction corresponding to the rear end portion of said substrate in the direction opposite to the ink ejecting direction, and is recessed into a configuration avoiding interference with said connecting portion of said substrate; and mounting means for mounting said ink-jet head.

18. An ink-jet printing apparatus as in claim 17, wherein said mounting means mounts said ink-jet head with said ink ejection openings oriented downwardly.

19. An ink-jet printing apparatus, comprising:

an ink-jet head comprising:

a substrate having a plurality of ejection energy generating elements thereon and a plurality of wirings for driving said elements, respectively, a connecting portion for electrically connecting said wirings at a rear end portion thereof;

an upper plate member fitted to said substrate and having a plurality of ink ejection openings, a plurality of nozzle portions which are part of a plurality of ink passages communicated with said ink ejection openings, a recessed portion comprising at least one common liquid chamber communicated with said nozzle portions, an opening portion communicated with said recessed portion, and a rear end surface, said common liquid chamber having a first inner side surface extending from the ink ejection opening side to the opening portion, a second inner side surface extending from the side opposite to the ink ejection opening side to the opening portion; and wherein the first inner side surface of said common liquid chamber is tilted in a direction opposite to an ink ejecting direction, the second inner side surface of said common liquid chamber is tilted in a same direction as the first inner side surface, and a tilting angle of the second inner side surface is greater than a tilting angle of the first inner side surface; and wherein the rear end surface of said upper plate member is tilted in a direction opposite to an ink ejecting direction corresponding to a rear end portion of said substrate in the direction opposite to the ink ejecting direction, and is recessed into a configuration avoiding interference with said connecting portion of said substrate; and mounting means for mounting said ink-jet head.

20. An ink-jet printing apparatus as in claim 19, wherein said mounting means mounts said ink-jet head with said ink ejection openings oriented downwardly.

* * * * *

UNITED STATES PATENT AND TRADEMARK OFFICE

CERTIFICATE OF CORRECTION

PATENT NO. : 6,039,437
DATED : March 21, 2000
INVENTOR(S) : Akira Tsujimoto

It is certified that error appears in the above-identified patent and that said Letters Patent is hereby corrected as shown below:

COLUMN 5:
Line 5, "operation, " should read --operation--;
Line 7, "portion" should read --portion of --; and "of" (second occurrence) should be deleted.

COLUMN 7:
Line 4, "correspond-" should read --(correspond---;
Line 6, "26CY." should read --26C4) .--

COLUMN 9:
Line 31, "array" should read --way--;
Line 43, "the" should read --with the--;
Line 59, "reciprocative" should read --reciprocatively--.

COLUMN 11:
Line 48, "thereof" should read --thereof; and --;
Line 61, "election" should read --ejection--;
Line 62, "portion; and" should read --portion,--;
Line 67, "said" should read --the--.

UNITED STATES PATENT AND TRADEMARK OFFICE

CERTIFICATE OF CORRECTION

PATENT NO. : 6,039,437
DATED : March 21, 2000
INVENTOR(S) : Akira Tsujimoto

It is certified that error appears in the above-identified patent and that said Letters Patent is hereby corrected as shown below:

COLUMN 12:
Line 5, "as" should read --as claimed--;
Line 9, "election" should read -- ejection--;
Line 13, "thereof;" should read -- thereof; and--;
Line 15, "election" should read -- ejection--;
Line 17, "election" should read -- ejection--;
Line 20, "poriton said" should read --portion--;
Line 23, "election" should read -- ejection--;
Line 25, "election" should read -- ejection--;
Line 26, "portion; and" should read -- portion,--;
Line 40, "thereof ;" should read --thereof ; and--;
Line 53, "election" should read --ejection--;
Line 54, "portion; and" should read --portion,--.

COLUMN 13:
Line 1, "as" should read -- as claimed--;
Line 13, "thereof;" should read --thereof, and--;
Line 18, "election" should read --ejection--;
Line 21, "election" should read --ejection--;
Line 24, "said" (first occurrence) should read --side--;
Line 45, "as" should read --as claimed--;
Line 49 , "comprising;" should read --comprising:--;
Line 50, "election" should read --ejection--;
Line 54, "thereof," should read --thereof; and --;
Line 58, "election" should read --ejection--;
Line 64, "election" should read --ejection--;
Line 66, "election" should read --ejection--;
Line 67, "portion; and" should read --portion,--.

UNITED STATES PATENT AND TRADEMARK OFFICE

CERTIFICATE OF CORRECTION

PATENT NO. : 6,039,437
DATED : March 21, 2000
INVENTOR(S) : Akira Tsujimoto

It is certified that error appears in the above-identified patent and that said Letters Patent is hereby corrected as shown below:

COLUMN 14:

Line 3, "electing" should read --ejecting--;
Line 12, "comprising;" should read --comprising:--;
Line 17, "thereof;" should read -- thereof; and;
Line 28, "portion." should read -- portion and --;
Line 30, "portion; and" should read --portion,--;
Line 37, " first" should read --second inner side surface is greater that a tilting angle of the first--;
Line 41, "as" should read --as claimed--;
Line 51, " thereof," should read --thereof; and--;
Line 54, "a part" should read --part--;
Line 64, "portion; and" should read --portion,--.

COLUMN 15:

Line 6, "as" should read --as claimed--;
Line 15, "thereof;" should read --thereof; and --.

UNITED STATES PATENT AND TRADEMARK OFFICE

CERTIFICATE OF CORRECTION

PATENT NO. : 6,039,437
DATED : March 21, 2000
INVENTOR(S) : Akira Tsujimoto

It is certified that error appears in the above-identified patent and that said Letters Patent is hereby corrected as shown below:

COLUMN 16:
Line 4, "portion; and" should read --portion,--;
Line 20, "as" should read --as claimed--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*